United States Patent [19]

Johnson et al.

[11] Patent Number: 4,835,541

[45] Date of Patent: May 30, 1989

[54] NEAR-ISOTROPIC LOW-PROFILE MICROSTRIP RADIATOR ESPECIALLY SUITED FOR USE AS A MOBILE VEHICLE ANTENNA

[75] Inventors: Russell W. Johnson; Robert E. Munson, both of Boulder, Colo.

[73] Assignee: Ball Corporation, Muncie, Ind.

[21] Appl. No.: 946,788

[22] Filed: Dec. 29, 1986

[51] Int. Cl.[4] ..... H01Q 1/32; H01Q 1/38

[52] U.S. Cl. ..... 343/713; 343/700 MS

[58] Field of Search ..... 343/700 MS, 702, 712, 343/713, 767, 795, 869

[56] References Cited

U.S. PATENT DOCUMENTS

| | | | |
|---|---|---|---|
| 1,649,510 | 0/1927 | Clough | 343/713 |
| 2,508,085 | 0/1950 | Alford | 343/767 |
| 3,465,985 | 0/1969 | Von Gohren | 343/767 |
| 3,623,108 | 0/1971 | DuBois et al. | 343/712 |
| 3,680,136 | 0/1972 | Collins | 343/746 |
| 3,710,338 | 0/1973 | Munson | 343/708 |
| 3,714,659 | 0/1973 | Firman | 343/701 |
| 3,736,591 | 5/1973 | Rennels et al. | 343/702 |
| 3,739,386 | 0/1973 | Jones | 343/708 |
| 3,939,423 | 0/1976 | Zakharov et al. | 325/312 |
| 4,051,477 | 0/1977 | Murphy et al. | 343/700 MS |
| 4,080,603 | 0/1978 | Moody | 343/712 |
| 4,124,851 | 11/1978 | Aaron et al. | 343/772 |
| 4,131,893 | 12/1978 | Munson et al. | 343/700 MS |
| 4,184,160 | 0/1980 | Affronti | 343/712 |
| 4,208,660 | 0/1980 | McOwen | 343/769 |
| 4,379,296 | 0/1983 | Farrar et al. | 343/700 MS |
| 4,521,781 | 0/1985 | Campi et al. | 343/700 MS |
| 4,538,153 | 0/1985 | Taga | 343/700 MS |
| 4,600,018 | 7/1986 | James et al. | 343/700 MS |
| 4,605,933 | 8/1986 | Butsher | 343/700 MS |
| 4,717,920 | 1/1988 | Ohe et al. | 343/713 |

FOREIGN PATENT DOCUMENTS

| | | | |
|---|---|---|---|
| 0163454 | 12/1985 | European Pat. Off. | 343/700 MS |
| 174068 | of 1986 | European Pat. Off. . | |
| 57-63904 | of 1982 | Japan | 343/700 MS |
| 57-75005 | of 1982 | Japan . | |
| 59-16402 | of 1984 | Japan . | |
| 0007204 | 1/1985 | Japan | 343/702 |
| 1103316 | of 1984 | U.S.S.R. . | |
| 1457173 | of 1976 | United Kingdom . | |

*Primary Examiner*—William L. Sikes
*Assistant Examiner*—Doris J. Johnson
*Attorney, Agent, or Firm*—Gilbert E. Alberding

[57] ABSTRACT

A compact, easy to manufacture quarter-wavelength microstrip element especially suited for use as a mobile radio antenna has performance which is equal to or better than conventional quarter wavelength whip-type mobile radio antennas. The antenna is not visible to a passerby observer when installed, since it is literally part of the vehicle. The microstrip radiating element is conformal to a passenger vehicle, and may, for example, be mounted under a plastic roof between the roof and the headliner.

20 Claims, 7 Drawing Sheets

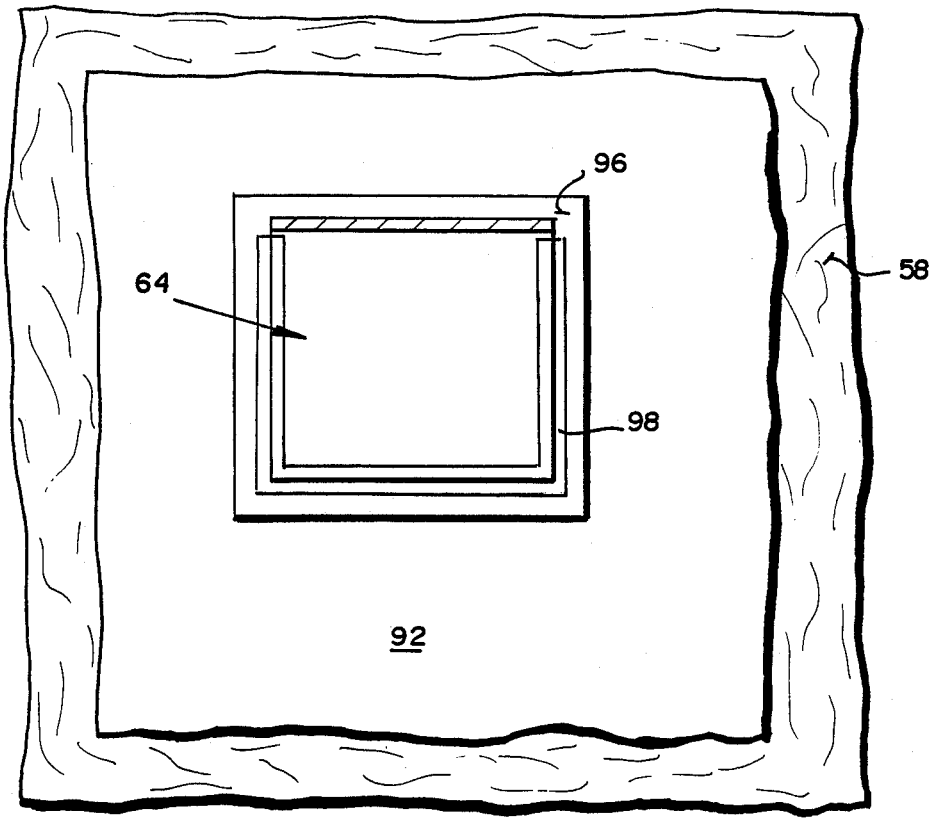
FIG. 3
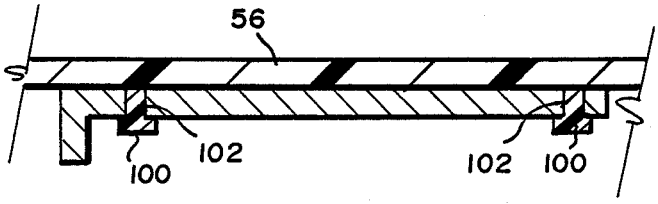
FIG. 4
FIG. 5
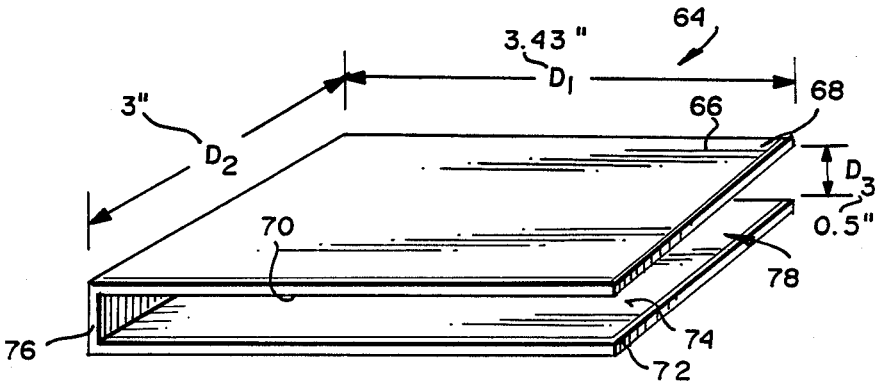

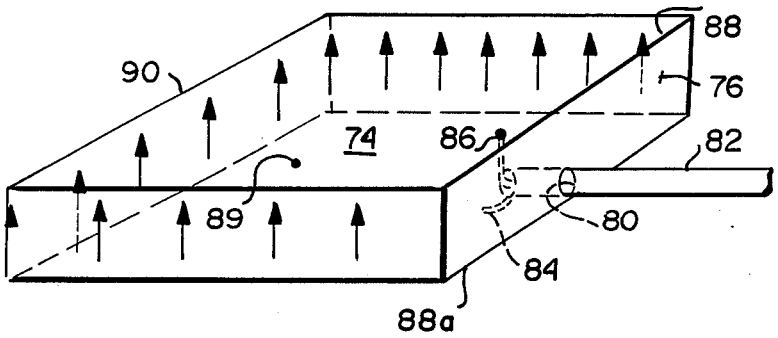
FIG. 6A
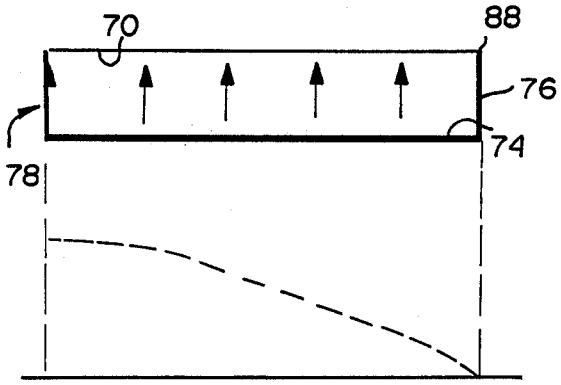
FIG. 6B
FIG. 8
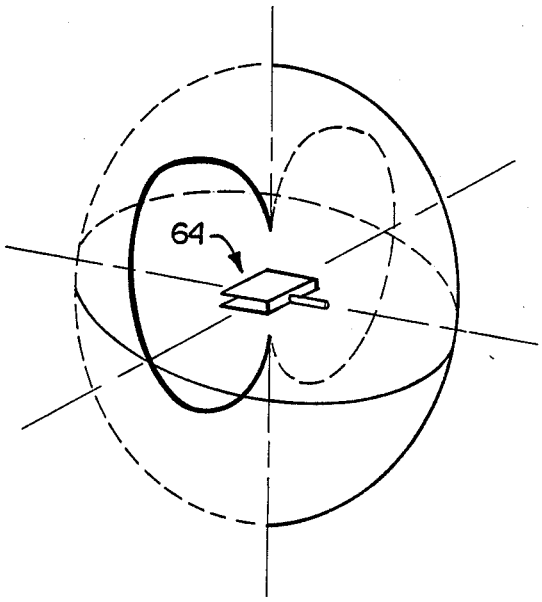
FIG. 7
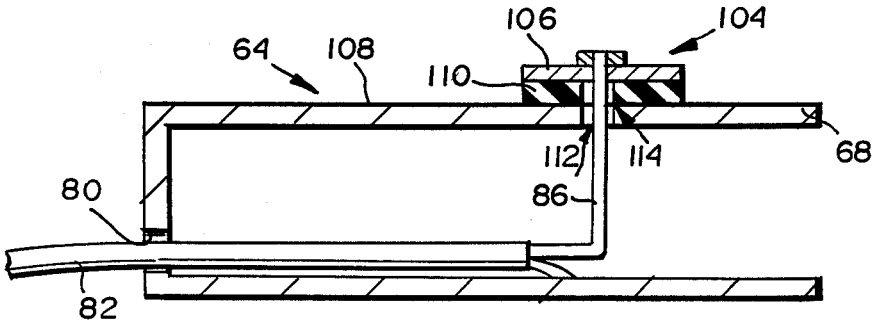

NEAR-ISOTROPIC LOW-PROFILE MICROSTRIP RADIATOR ESPECIALLY SUITED FOR USE AS A MOBILE VEHICLE ANTENNA

This application is related to copending commonly-assigned application Ser. No. 945,613 of Johnson et al, filed Dec. 23, 1986 entitled "CIRCULAR MICROSTRIP VEHICULAR RF ANTENNA".

This invention generally relates to radio-frequency antenna structures and, more particularly, to low-profile resonant microstrip antenna radiators.

Microstrip antennas of many types are well known in the art. Briefly, microstrip antenna radiators comprise resonantly dimensioned conductive surfaces disposed less than about 10th of a wave length above a more extensive underlying conductive ground plane. The radiator element may be spaced above the ground plane by an intermediate dielectric layer or by a suitable mechanical standoff post or the like. In some forms (especially at higher frequencies), microstrip radiators and interconnecting microstrip RF feedline structures are formed by photochemical etching techniques (like those used to form printed circuits) on one side of a doubly clad dielectric sheet, with the other side of the sheet providing at least part of the underlying ground plane or conductive reference surface.

Microstrip radiators of various types have become quite popular due to several desirable electrical and mechanical characteristics. The following listed references are generally relevant in disclosing microstrip radiating structures:

| Inventor | Patent No. | Issued |
|---|---|---|
| Murphy et al | 4,051,477 | Sep. 27, 1977 |
| Taga | 4,538,153 | Aug. 27, 1985 |
| Campi et al | 4,521,781 | Jun. 4, 1985 |
| Munson | 3,710,338 | Jan. 9, 1973 |
| Sugita | Jap. 57-63904 | Apr. 17, 1982 |
| Jones | 3,739,386 | Jun. 12, 1973 |
| Firman | 3,714,659 | Jan. 30, 1973 |
| Farrar et al | 4,379,296 | Apr. 5, 1983 |

Although microstrip antenna structures have found wide use in military and industrial applications, the use of microstrip antennas in consumer applications has been far more limited—despite the fact that a great many consumers use high frequency radio communications every day. For example, cellular car radio telephones, which are becoming more and more popular and pervasive, could benefit from a low-profile microstrip antenna radiating element if such an element could be conveniently mounted on or in a motor vehicle in a manner which protects the element from the environment—and if such an element could provide sufficient bandwidth and omnidirectivity once installed.

The following list of patents are generally relevant in disclosing automobile antenna structures:

| Inventor | Patent No. | Issued |
|---|---|---|
| Moody | 4,080,603 | Mar. 21, 1978 |
| Affronti | 4,184,160 | Jan. 15, 1980 |
| DuBois et al | 3,623,108 | Nov. 23, 1971 |
| Zakharov et al | 3,939,423 | Feb. 17, 1976 |
| Chardin | UK 1,457,173 | Dec. 1, 1976 |
| Boyer | 2,996,713 | Aug. 15, 1961 |
| Allen, Jr., et al | 4,317,121 | Feb. 23, 1982 |
| Gabler | 2,351,947 | June 20, 1944 |

-continued

| Inventor | Patent No. | Issued |
|---|---|---|
| Okumura | 3,611,388 | October 5, 1971 |

Mobile radio communications presently relies on conventional whip-type antennas mounted to the roof, hood, or trunk of a motor vehicle. This type of conventional whip antenna is shown in prior art FIG. 1. A conventional whip antenna typically includes a half-wavelength vertically-oriented radiating element 12 connected by a loading coil 14 to a quarter-wavelength vertically-oriented radiating element 16. The quarter-wavelength element 16 is mechanically mounted to a part of the vehicle.

Although this type of whip antenna generally provides acceptable mobile communications performance, it has a number of disadvantages. For example, a whip antenna must be mounted on an exterior surface of the vehicle, so that the antenna is unprotected from the weather (and may be damaged by car washes unless temporarily removed). Also, the presence of a whip antenna on the exterior of a car is a good clue to thieves that an expensive radio telephone transceiver probably is installed within the car.

The Moody and Affronti patents listed above disclose externally-mounted vehicle antennas which have some or all of the disadvantages of the whip-type antenna.

The DuBois and Zakharov et al patents disclose antenna structures which are mounted in or near motor vehicle windshields within the vehicle passenger compartment. While these antennas are not as conspicuous as externally-mounted whip antennas, the significant metallic structures surrounding them may degrade their radiation patterns.

The Chardin British patent specification discloses a portable antenna structure comprising two opposed, spaced apart, electrically conductive surfaces connected together by a lump-impedance resonant circuit. One of the sheets taught by the Chardin specification is a metal plate integral to the metal chassis of a radio transceiving apparatus, while the other sheet is a metal plate (or a piece of copper-clad laminate of the type used for printed circuit boards) which is spaced away from the first sheet.

The Boyer patent discloses a radio wave-guide antenna including a circular flat metallic sheet uniformly spaced above a metallic vehicle roof and fed through a capacitor.

Gabler and Allen Jr., et al disclose high frequency antenna structures mounted integrally with non-metallic vehicle roof structures.

Okumura et al teaches a broadcast band radio antenna mounted integrally within the trunk lid of a car.

It would be highly desirable to provide a low profile microstrip-style radiating element which has a relatively large bandwidth, can be inexpensively produced in high volumes, can be installed integrally within or inside a structure found in most passenger vehicles, and which provides a nearly isotropic vertical directivity pattern.

SUMMARY OF THE INVENTION

The radiating element provided by the present invention need not utilize more ground plane than the size of the radiating element itself, and may be fed simply from unbalanced transmission line protruding through a shorted side of the radiating element. Because the element ground plane has the same dimensions as the radiating element, radiating RF fields "spill over" to the ground plane side in a manner which provides a substantially isotropic radiation pattern. That is, in two of the three principal radiating dimensions, the radiation characteristics of the antenna are essentially omnidirectional. In the third dimension, a radiation pattern similar to that of a monopole is produced. No baluns or chokes are required by the radiating element—since the impedance of the radiating element can be matched to that of an unbalanced coaxial transmission line directly connected to the element.

The radiating antenna structure of the present invention can easily be mass-produced and installed in passenger vehicles as standard or optional equipment due to its excellent performance, compactness and low cost.

In somewhat more detail, a low profile antenna structure of the invention includes first and second electrically conductive surfaces which are substantially parallel to, opposing and spaced apart from one another. A transmission line couples radio frequency signals to and/or from the first and second conductive surfaces. The radio frequency signal radiation pattern of the resulting structure is nearly isotropic (e.g., substantially isotropic in two dimensions).

The first and second electrically conductive surfaces may have substantially equal dimensions, and may be defined by a sheet of conductive material folded into the shape of a "U" to define a quarter-wavelength resonant cavity therein. Impedance matching may be accomplished by employing an additional microstrip patch capacitively coupled to the first or second conductive surface.

The antenna structure of the invention may be installed in an automobile of the type having a passenger compartment roof including a rigid outer non-conductive shell and an inner headliner layer spaced apart from the outer shell to define a cavity therebetween. The antenna structure may be disposed within that cavity, with one of the conductive surfaces mechanically mounted to an inside surface of the outer shell.

BRIEF DESCRIPTION OF THE DRAWINGS

These and other features and advantages of the present invention may be better and more completely understood by referring to the following detailed description of preferred embodiments in conjunction with appended sheets of drawings, of which:

FIG. 3 is a top view in plan and partial cross-section of the embodiment shown in FIG. 2;

FIG. 4 is a side view in cross-section of the embodiment shown in FIG. 2 showing in detail the manner in which the radiating element is mounted to an outer, non-conductive roof structure of the vehicle;

FIG. 5 is a side view in perspective of the radiating element shown in FIG. 2;

FIG. 6A is a side and schematic view in perspective of the radiating element shown in FIG. 2 showing in detail an exemplary arrangement for feeding the radiating element;

FIG. 6B is a graphical view of the intensity of the electromagnetic lines of force existing between the conductive surfaces of the radiating structure shown in FIG. 6A;

FIG. 7 is a side view in cross-section of another exemplary arrangement for feeding the radiating element shown in FIG. 2 including a particularly advantageous impedance matching arrangement;

FIG. 8 is a schematic diagram of the vertical directivity pattern of the radiating element shown in FIG. 2;

DETAILED DESCRIPTION OF PREFERRED EMBODIMENTS

Figure 2A:
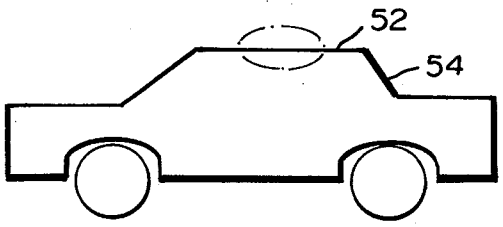
FIG. 2A is a schematic view of a passenger vehicle the roof structure of which is shown in detail in FIG. 2.
Figure 1:
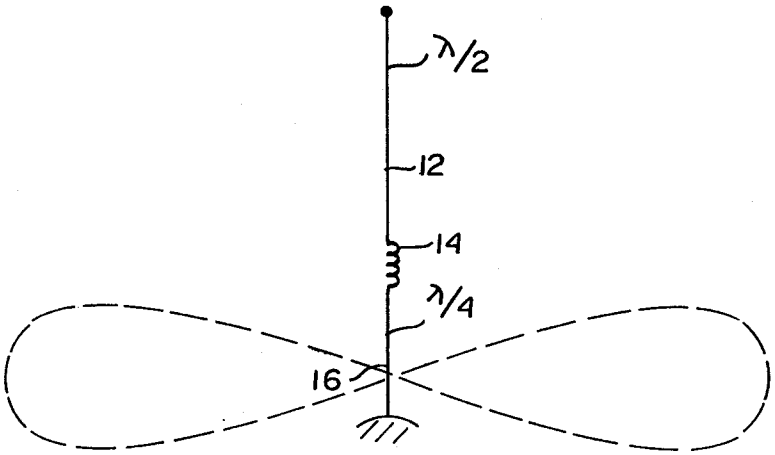
FIG. 1 PRIOR ART
FIG. 1 is a schematic side view of a prior art whip-type quarter-wavelength mobile antenna radiator.
Figure 2:
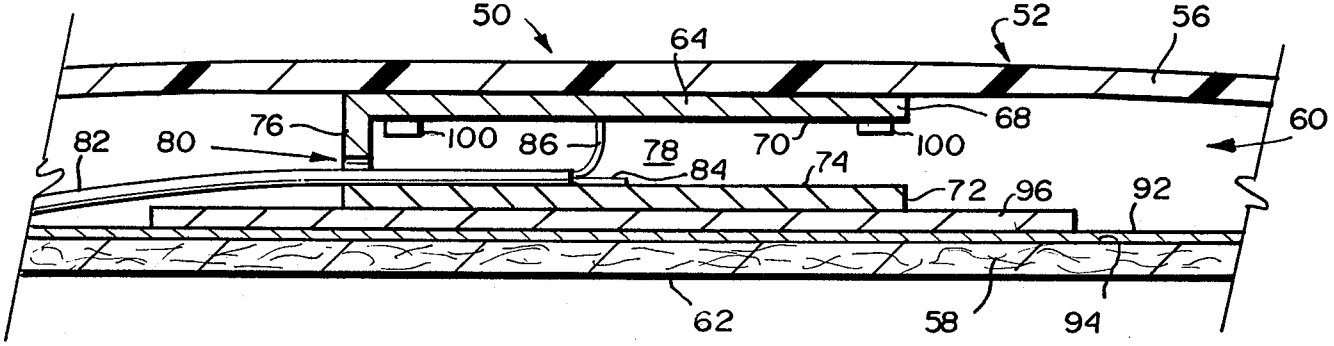
FIG. 2 is a side view in cross-section of a presently preferred exemplary embodiment of the present invention.

FIG. 2 is a side view in cross-section of a presently preferred exemplary embodiment of a vehicle-installed ultra high frequency (UHF) radio frequency signal antenna structure 50 in accordance with the present invention.

Antenna structure 50 is installed within a roof structure 52 of a passenger automobile 54 in the preferred embodiment. Passenger automobile roof structure 52 includes an outer rigid non-conductive (e.g., plastic) shell 56 and an inner "headliner" layer 58 spaced apart from the outer shell to form a cavity 60 therebetween.

Headliner 58 typically is made of cardboard or other inexpensive, thermally insulative material. A layer of foam or cloth (not shown) may be disposed on a headliner surface 62 bounding the passenger compartment of automobile 54 for aesthetic and other reasons. Headliner 58 is the structure typically thought of as the inside "roof" of the automobile passenger compartment (and on which the dome light is typically mounted).

Outer shell 56 is self-supporting, and is rigid and strong enough to provide good protection against the weather. Shell 56 also protects passengers within automobile 54 in case the automobile rolls over in an accident and comes to an upside-down resting position.

A radiating element 64 is disposed within cavity 60 and is mounted to outer shell 56. Referring now more particularly to FIGS. 2 and 5, radiating element 64 includes a thin rectangular sheet 66 of conductive material (e.g., copper) folded over to form the shape of the letter "U". Sheet 66 thus folded has three parts: an upper section 68 defining a first conductive surface 70; a lower section 72 defining a second conductive surface 74; and a shorting section 76 connecting the upper and lower sections.

Sheet 66 may have rectangular dimensions of 3 inches×7.36 inches and is folded in the preferred embodiment so that upper and lower conductive surfaces 70, 74 are parallel to and opposing one another, are spaced apart from one another by approximately 0.5 inches, and have equal rectangular dimensions of approximately 3 inches×3.43 inches (the 3.43 inch dimension being determined by the frequency of operation of element 64 and preferably defining a quarter-wavelength cavity corresponding to that frequency). In the preferred embodiment, upper and lower sections 68, 72 each meet shorting section 76 in a right angle.

Element 68 can be fabricated using simple, conventional techniques, (for example, sheet metal stamping). Because of the simple construction of element 64, it can be inexpensively mass-produced to provide a low-cost mobile radio antenna.

In the preferred embodiment, lower conductive surface 74 acts as a ground plate, upper conductive surface 70 acts as a radiating surface, shorting section 76 acts as a shorting stub, and a quarter-wavelength resonant cavity 78 is defined between the upper and lower conductive surfaces.

Although a variety of different arrangements for connecting a RF transmission line to radiating element 64 might be used, a particularly inexpensive feed structure is used in the preferred embodiment. A hole 80 is drilled through shorting section 76, and an unbalanced transmission line such as a coaxial cable 82 is passed through the hole. The outer coaxial cable "shield" conductor 84 is electrically connected to lower conductive surface 74 (e.g., by a solder joint or the like), and the center coaxial conductor 86 is electrically connected to upper conductive surface 70 (also preferably by a conventional solder joint). A conventional rigid feed-through pin can be used to connect the coax center conductor 86 to upper surface 70 if desired. A small hole may be drilled through upper section 68 (at a point determined experimentally to yield a suitable impedance match so that no balun or other matching transformer is required) for the purpose of electrically connecting center conductor 86 (or feed-through pin) to the upper conductive surface. Radiating element 64 is thus fed internally to cavity 78 (i.e., within the space defined between upper and lower surfaces 70, 74).

When an RF signal is applied to coaxial cable 82 (this RF signal may be produced by a conventional radio frequency transmitter operating within the frequency range of 800–900 megahertz), electromagnetic lines of force are induced across resonant cavity 78. As may best be seen in FIGS. 6A and 6B, shorting section 76 electrically connects lower conductive surface 74 to upper conductive surface 70 at an edge 88 of the upper conductive surface, so that upper conductive surface edge 88 always has the same potential as the lower conductive surface—and there is little or no difference in potential between upper conductive surface edge 88 and corresponding edge **88*a*** of the lower conductive surface.

The instantaneous potential at an arbitrary point 89 on upper conductive surface 70 located away from edge 88 varies with respect to the potential of lower conductive surface 74 as the RF signal applied to coaxial cable 82 varies—and the difference in potential is at a maximum at upper conductive surface edge 90 (the part of upper conductive surface 70 which is the farthest away from edge 88). The length of resonant cavity 78 between shorting section 76 and edge 90 is thus a quarter-wavelength in the preferred embodiment (as can be seen in FIG. 6B).

Because upper and lower conductive surfaces 70, 74 have the same dimensions (i.e., the orthographic projection of one of these surfaces onto the plane of the other surface is coextensive with the other surface), radiated radio frequency energy is allowed to "spill over" from the volume "above" upper conductive surface 70 to the volume "beneath" lower conductive surface 74. Hence, as may best be seen in FIG. 8, the radiation (directivity) pattern of radiating element 64 is circular in two dimensions defined by a Cartesian coordinate system and nearly circular in the third dimension defined by the coordinate system. In other words, radiating element 64 has substantially isotropic radiating characteristics in at least two dimensions.

As is well known, the radiation from a practical antenna never has the same intensity in all directions. A hypothetical "isotropic radiator" has a spherical "solid" (equal field strength contour) radiation pattern, since the field strength is the same in all directions. In any plane containing the isotropic antenna (which may be considered "point source"), the radiating pattern is a circle with the antenna at its center. The isotropic antenna thus has no directivity at all. See *ARRL Antenna Book*, page 36 (American Radio Relay League, 13th Edition, 1974).

Figure 9:
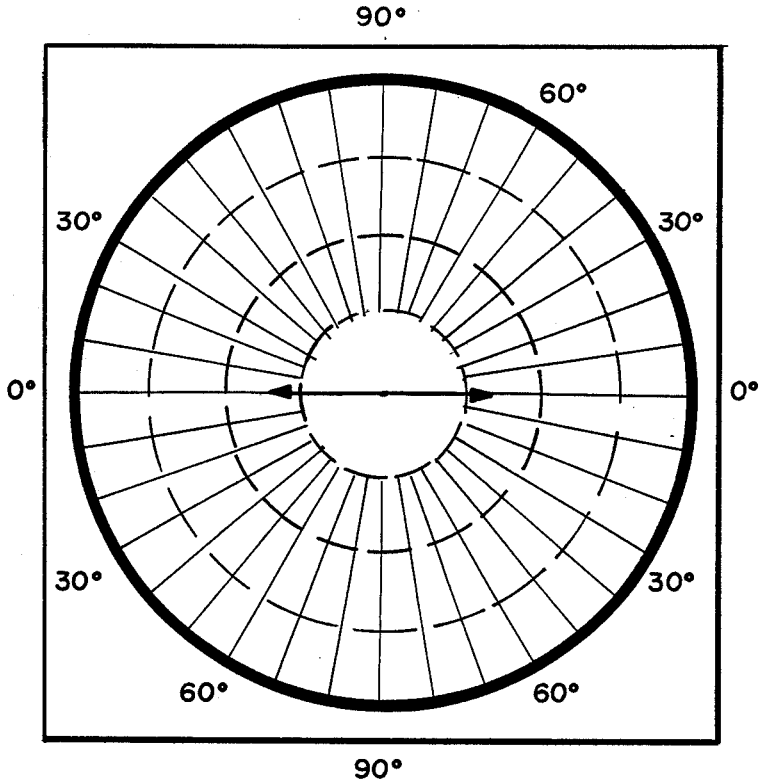
FIG. 9 is a graphical illustration of the E-plane directivity diagram of the antenna structure shown in FIG. 2.
Figure 11:
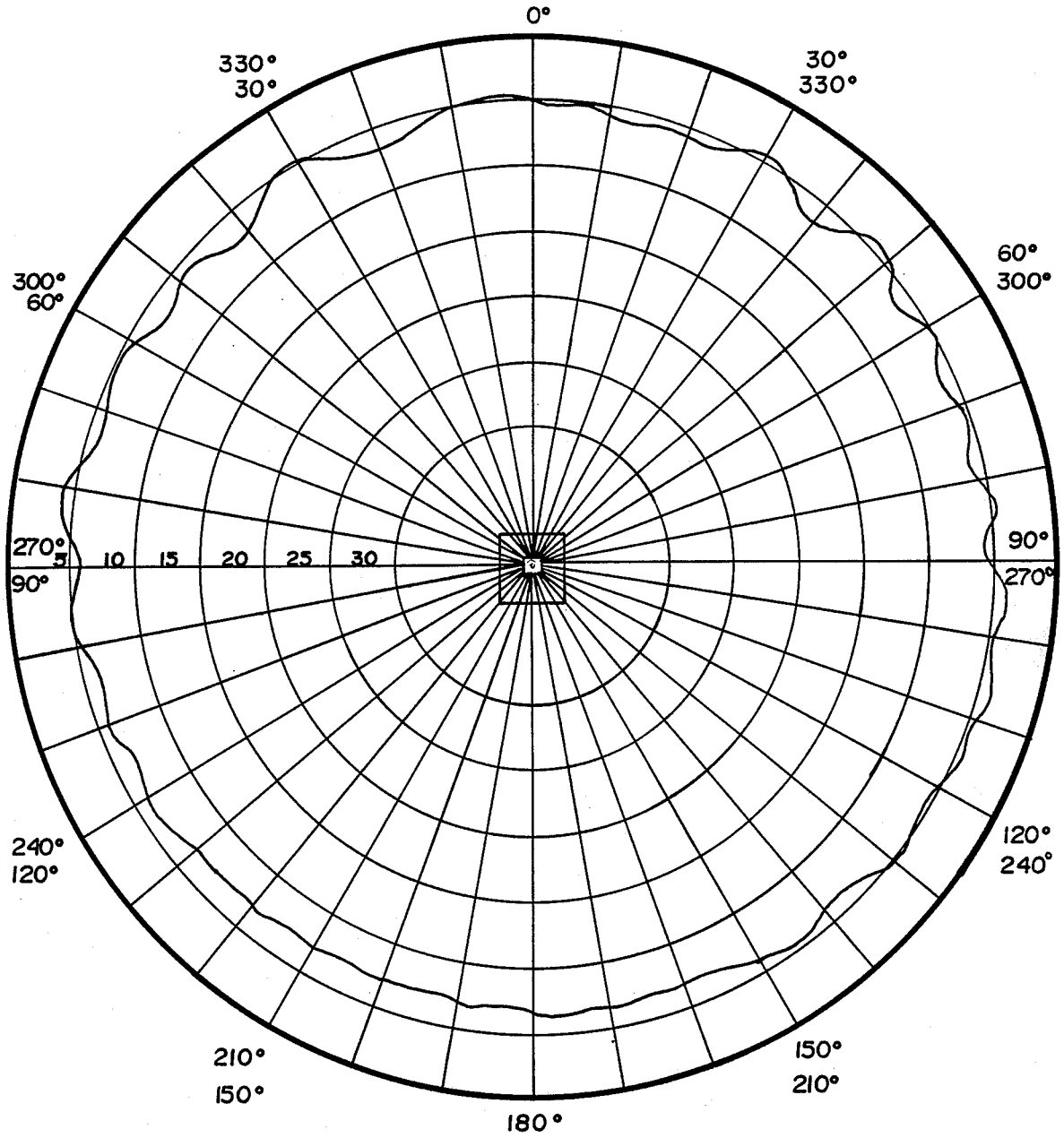
FIG. 11 is a graphical illustration of actual experimental results showing the E-plane directivity diagram of the structure shown in FIG. 2 measured at a frequency of 875 megahertz.

As can be seen in FIG. 9 (which is a graphical illustration of the approximate radiation pattern of radiating element 64) and FIG. 11 (which is a graphical plot of actual experimental field strength measurements of the antenna structure shown in FIG. 2), the E-plane (vertically polarized) RF radiation pattern of antenna structure 50 is very nearly circular, and thus, the antenna structure has an omnidirectional vertically polarized radiation pattern. Variations in the test results shown in FIG. 11 from an ideal circular pattern are attributable to ripple from the range rather than to directivity of antenna structure 50.

Figure 10:
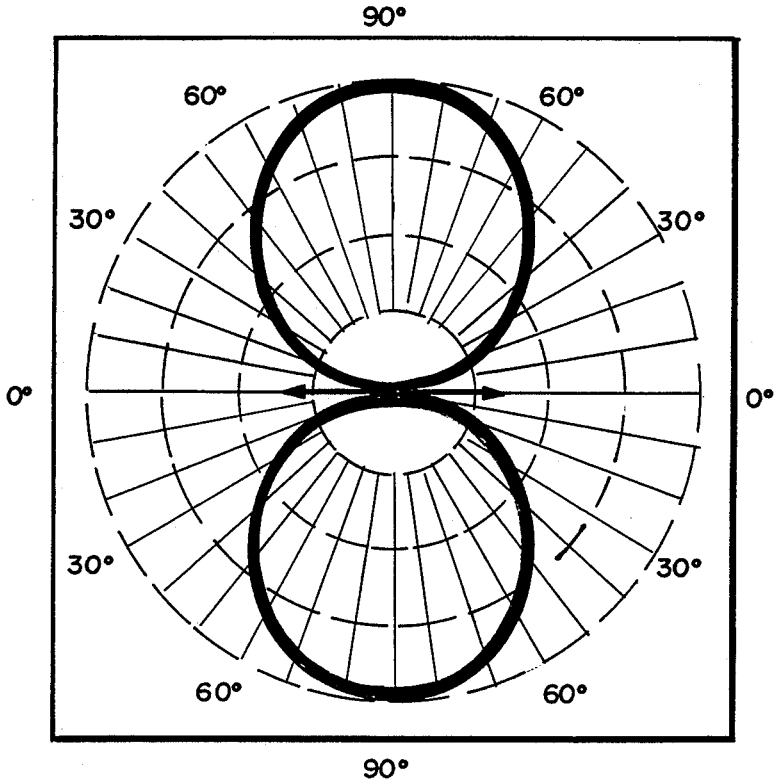
FIG. 10 is a graphical illustration of the H-plane directivity diagram of the antenna structure shown in FIG. 2.

Due to the phase relationships of the RF fields generated by radiating element 64, the H-plane radiation pattern of antenna structure 50 is not quite circular, but instead resembles that of a monopole (as can be seen in FIGS. 8 and 10) with a pair of opposing major lobes. However, this slight directivity of antenna structure 50 (i.e., slight deviation from the radiation characteristics of a true isotropic radiator) has little or no effect on the performance of the antenna structure as installed in passenger automobile 54. This is because nearly all of the transmitting and receiving antennas of interest to passengers within automobile 54 are vertically polarized and lie within approximately the same plane (plus or minus 30 degrees or so) as that defined by roof structure 52. Radiation emitted directly upward or downward by antenna structure 50 (i.e., along the 0 degree axis of FIG. 10) would generally be wasted, since it would either be absorbed by the ground or simply travel out into space. At any rate, radiating element 64 does emit horizontally polarized RF energy directly upwards (i.e., in a direction normal to the plane of upper surface 70) and can thus be used to communicate with satellites (which typically have circularly polarized antennas).

Referring now to FIGS. 2–4, one exemplary method of mounting radiating element 64 within roof cavity 60 will now be discussed. In the preferred embodiment, layer of conductive film 92 (e.g., aluminum foil) is disposed on a surface 94 of headliner 58 bounding cavity 60. Film 92 is preferably substantially coextensive with roof structure 52, and is connected to metal portions of automobile 54 at its edges. Film 92 prevents RF energy emitted by radiating element 64 from passing through headliner 58 and entering the passenger compartment beneath the headliner.

In the preferred embodiment, a thin sheet 96 of conductive material (e.g., copper) which has dimensions which are larger than those of upper and lower radiator sections 68, 72 is rested on film layer 92 (for example, sheet 96 may have dimensions of 10 inches×17 inches). Lower radiator section 2 is then disposed directly on sheet 96 (conductive bonding between lower section 72 and sheet 96 may be established by strips of conductive aluminum tape 98). Non-conductive (e.g., plastic) pins 100 passing through corresponding holes 102 drilled through upper radiator section 68 may be used to mount radiating element 64 to outer shell 56. It is desirable to incorporate some form of impedance matching network into antenna structure 50 in order to match the impedance of radiating element 64 with the impedance of coaxial cable 82 at frequencies of interest. The section of coaxial cable center conductor 86 connected to upper conductive surface 70 (or feed-through pin used to connect the center conductor to the upper surface) introduces an inductive reactance which may cause radiating element 64 to have an impedance which is other than a pure resistance at the radio frequencies of interest. FIG. 7 shows another version of radiating element 64 which has been slightly modified to include an impedance matching network 104.

Impedance matching network 104 includes a small conductive sheet 106 spaced above an upper conductive surface 108 of upper radiator section 68 and separated from surface 108 by a layer 110 of insulative (dielectric) material. In the preferred embodiment, layer 110 comprises a layer of printed circuit board-type laminate, and sheet 106 comprises a layer of copper cladding adhered to the laminate. A hole 112 is drilled through upper radiator section 68, and another hole 114 is drilled through layer 110 and sheet 106. Coaxial cable center conductor section 86 (or a conventional feed-through pin electrically and mechanically connected to the coaxial cable center conductor) passes through holes 12, 114 without electrically contacting upper radiator section 68 and is electrically connected to copper sheet 106 (e.g., by a conventional solder joint).

Sheet 106 is capacitively coupled to upper radiator section 68—introducing capacitive reactance where coaxial cable 82 is coupled to radiating element 64. By selecting the dimensions of sheet 106 appropriately, the capacitive reactance so introduced can be made to exactly equal the inductive reactance of feed-through pin 86 at the frequencies of operation—thus forming a resonant series LC circuit.

Figure 12:
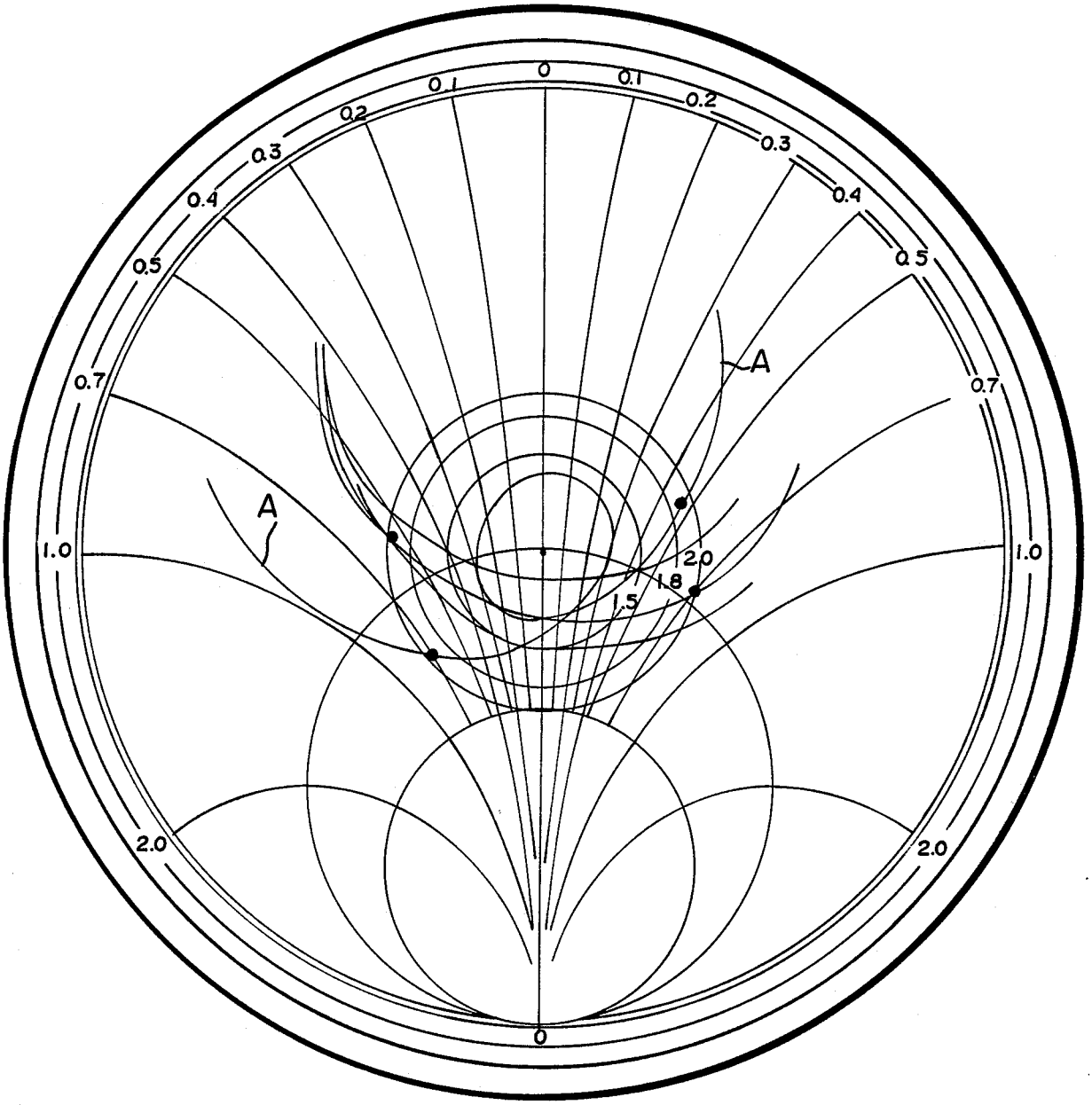
FIG. 12 is a graphical illustration of a Smith chart on which is plotted VSWR versus frequency or the structure shown in FIG. 7.

FIG. 12 is a plot (on a Smith chart) of actual test results obtained for the arrangement shown in FIG. 7. Curve "A" plotted in FIG. 12 has a closed loop within the 1.5 VSWR circle due to the resonance introduced by network 104. With radiator 64 having the dimensions described previously and also including impedance matching network 104, antenna structure 50 has VSWR of equal to or less than 2.0:1 over the range of 825 megahertz to 890 megahertz—plus or minus 3.5% or more from a center resonance frequency of about 860 megahertz (see curve A shown in FIG. 12).

Although impedance matching network 104 effectively widens the bandwidth of radiating element 64, the bandwidth of the radiating element is determined mostly by the spacing between upper and lower conductive surfaces 70, 74. The absolute and relative dimensions of upper and lower conductive surfaces 70, 74 affect both the center operating frequency and the radiation pattern of radiating element 64.

Although the dimensions of upper and lower surfaces 70, 74 are equal in the preferred embodiment, it is possible to make lower conductive surface 74 larger than upper conductive surface 70. When this is done, however, the omnidirectionality of radiating element 64 is significantly degraded. That is, as the size of lower conductive surface 74 is increased with respect to the size of upper conductive surface 70, radiating element 64 performs less like an isotropic radiator (i.e., point source) and begins to exhibit directional characteristics. Because a mobile radio communications antenna should have an omnidirectional vertically polarized radiation pattern, vertical polarization directivity is generally undesirable and should be avoided.

It is sometimes necessary or desirable to provide an outboard low noise amplifier between an antenna and a receiver input to amplify signals received by the antenna prior to applying the signals to the receiver input (thus increasing the effective sensitivity of the antenna and receiver)—and this amplifier should be physically located as close to the antenna as possible to reduce loss and noise. It may also be desirable or necessary to provide a power amplifier outboard of a radio transmitter to increase the effective radiated power of the transmitter/antenna combination.

Figure 13:
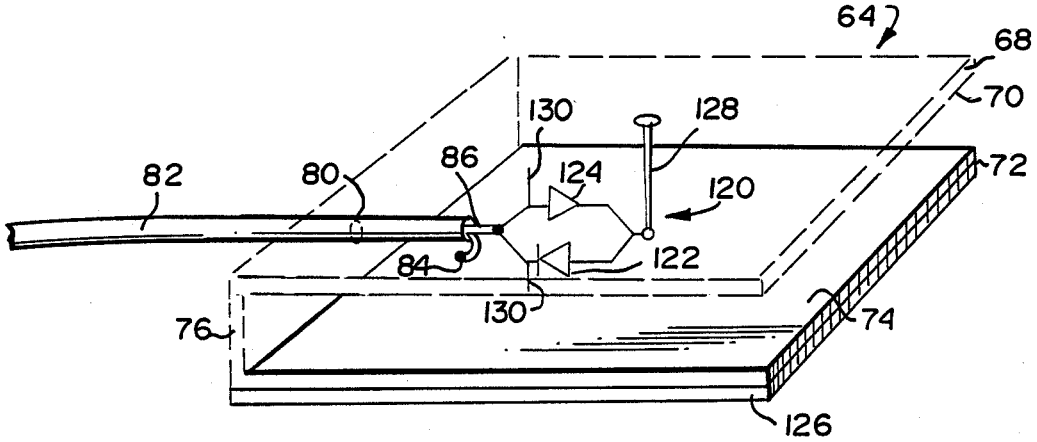
FIG. 13 is a partially cut-away side view in perspective of the radiating element shown in FIG. 2 including integral active amplifying circuit elements.

The embodiment shown in FIG. 13 includes a bidirectional active amplifier circuit 120 disposed directly on radiating element lower conductive surface 74. Circuit 120 includes a low noise input amplifier 122 and a power output amplifier 124. In this embodiment, lower radiator section 72 is preferably disposed on a conventional layer of laminate 126—and conventional printed circuit fabrication techniques are used to fabricate amplifiers 122 and 124.

Power is applied to amplifiers 122, 124 via an additional power lead (not shown) connected to a power source (e.g., the battery of vehicle 54). One "side" (i.e., the output of amplifier 122 and the input of amplifier 124) of each of the amplifiers 122, 124 is connected to coaxial cable center conductor 86, and the other "side" of each amplifier (i.e., the output of amplifier 124 and the input of amplifier 122) is connected (via a feed-through pin 128) to upper conductive surface 70.

Signals received by element 64 are amplified by low-noise amplifier 122 before being applied to the transceiver input via coaxial cable 82. Similarly, signals provided by the transceiver are amplified by amplifier 124 before being applied to upper conductive surface 70. The performance of the transceiver and of element 64 is thus increased without requiring any additional units in line between element 64 and the transceiver. Amplifier 120 can be made small enough so that its presence does not noticeably degrade the near isotropic r radiation characteristics of radiator element 64. Matching stubs 130 printed on surface 74 may be provided to match impedances.

Since RF signals are transmitted and received simultaneously by active amplifier circuit 120 and radiating element 64 in the preferred embodiment, a commercially available conventional duplexer or filter arrangement should be used to prevent receiver "front end overload" during RF signal transmission.

A new and advantageous antenna structure has been described which has a substantially isotropic RF radiation pattern, is inexpensive and easy to produce in large quantities, and has a low profile package. The antenna structure is conformal (that is, it may lie substantially within the same plane as its supporting structure), and because of its small size and planar shape, may be incorporated within the roof structure of a passenger vehicle. The antenna structure is ideally suited for use as a passenger automobile mobile radio antenna because of these properties.

While the present invention has been described with what is presently considered to be the most practical and preferred embodiments, it is to be understood that the appended claims are not to be limited to the disclosed embodiments, but on the contrary, are intended to cover all modifications, variations and/or equivalent arrangements which retain any of the novel features and advantages of this invention.

What is claimed is:

1. A low-profile antenna structure consisting of:

a first planar electrically conductive surface;

a second planar electrically conductive surface substantially parallel to, opposing and spaced apart from said first surface, said first and second conductive surfaces being dimensioned to provide a quarter-wave resonant cavity therebetween; and transmission line means for coupling radio frequency signals to and/or form said first and second surfaces, wherein the spacing and dimensions of said first and second surfaces are selected to produce a radio frequency signal radiation pattern which is substantially isotopic, wherein said first and second electrically conductive surfaces have substantially equal dimensions, and said transmission line means is connected to said first surface at a point internal to the volume disposed between said first and second surfaces, and comprises an unbalanced transmission line directly connected between said first and second surfaces.

2. An antenna structure as in claim 1 wherein said structure resonates at a first frequency and the spacing between said first and second surfaces provides a 2.0 VSWR bandwidth range of at least plus or minus 4.0% of said resonant frequency.

3. An antenna structure as in claim 1 wherein the spacing between said first and second surfaces provides a VSWR of 2.0 or less over the range of 825 megahertz to 890 megahertz.

4. An antenna structure as in claim 1 wherein said first and second conductive surfaces are defined by a rectangular sheet of conductive material folded into the shape of a "U".

5. An antenna structure as in claim 1 wherein said first and second surface spacing and dimensions are selected so as to produce a vertically polarized radiation pattern which is substantially omnidirectional in at least two dimensions.

6. An antenna structure as in claim 1 wherein said radiation pattern is isotropic in the plane of said first and second surfaces.

7. An antenna structure as in claim 1 wherein at least one dimension of said first surface is approximately a quarter-wavelength of the resonant wavelength of said antenna structure.

8. An antenna structure as in claim 1 further including amplifying means, disposed on said first surface and electrically connected to said transmission line means, for amplifying radio frequency signals applied to and/or received by said antenna.

9. An antenna as in claim 1 further including impedance matching means, electrically connected between said transmission line means and said first surface, for matching the impedance of said antenna with the impedance of said transmission line means.

10. An antenna structure comprising:

a layer of insulative material;

a sheet of conductive material folded into the shape of a U in cross-section, said U-shaped sheet having first and second electrically conductive surfaces electrically connected together at respective edges thereof, said first and second surfaces being substantially parallel to and spaced apart from one another, said first and second surfaces having substantially equal dimensions and defining a quarter-wavelength resonant cavity therebetween; and means for mechanically connecting said conductive sheet to said insulative layer, wherein the spacing and dimensions of said first and second sheets are selected so that the radiation pattern of said antenna is substantially isotropic in at least two dimensions, said antenna structure further including transmission line means directly electrically connected between said first and second surfaces at a point internal to said resonant cavity for coupling radio frequency signals to and/or from said sheet, and wherein the spacing between said first and second conductive surfaces is approximately ½ inches.

11. An antenna structure as in claim 10 further including:

a headliner layer spaced apart from said insulative layer, said headliner layer and insulative layer defining a chamber therebetween, said folded conductive sheet being disposed within said chamber; and a further, thin conductive sheet disposed on and substantially contiguous with said headliner layer.

12. In an automobile of the type including a rigid outer non-conductive exterior shell and an inner headliner layer spaced apart from said outer shell to define a cavity therebetween, a low-profile antenna structure comprising:

a first substantially planar conductive surface mounted to said outer shell and disposed within said cavity;

a second substantially planar conductive surface opposing and spaced apart from said first surface and disposed within said cavity; and transmission line means electrically coupled to said first and second surfaces for coupling radio frequency signals to and/or from said first and second surfaces, wherein the spacing and dimension of said first and second surfaces are selected so that said antenna structure has a substantially isotropic radiation pattern, and said first and second conductive surfaces are dimensioned to have substantially equal sizes and to provide a quarter-wavelength resonant cavity therebetween.

13. A vehicle including:

a rigid outer non-conductive shell covering a portion of the exterior of said vehicle;

an inner non-conductive layer spaced apart from said outer shell, a cavity being defined between said inner layer and said outer shell;

a single folded sheet of conductive material disposed within said cavity and mounted to said outer shell, said conductive sheet having first and second opposing planar conductive surfaces of substantially equal dimensions which define a quarter-wavelength resonant cavity therebetween; and transmission line means, electrically coupled to said conductive sheet, for coupling radio frequency signals to and/or from said sheet, wherein said folded conductive sheet has a nearly isotropic radio frequency signal radiation pattern.

14. A passenger vehicle including:

a rigid outer non-conductive shell covering a portion of the upper exterior of said vehicle;

an inner non-conductive headliner layer spaced apart from said outer shell, a cavity being defined between said headliner layer and said outer shell, said headliner layer bounding a passenger compartment of said vehicle;

a single sheet of conductive material disposed within said cavity and mounted to said outer shell, said conductive sheet folded in the shape of a U in cross-section, first and second planar opposing conductive surfaces of said folded sheet having substantially equal dimensions and forming the legs of said U, a quarter-wavelength resonant cavity being defined between said first and second conductive surfaces; and transmission line means, electrically coupled to said conductive sheet, for coupling radio frequency signals to and/or from said sheet, wherein said folded conductive sheet has a nearly isotropic radio frequency signal radiation pattern, and the projection of said first surface onto the plane of said second surface is coextensive with said second surface.

15. A vehicle as in claim 14 further including a thin layer of conductive material disposed on said headliner layer bounding said cavity.

16. A vehicle as in claim 14 further wherein said sheet has a VSWR of 2.0 or less over the frequency range of 825 to 890 megahertz.

17. A vehicle as in claim 14 further including amplifying means, disposed on said first surface and electrically connected between said transmission line means and said second surface, for coupling radio frequency signals between said transmission line means and said sheet and for amplifying said coupled signals.

18. A process for fabricating a mobile radio antenna including the steps of:

providing a rectangular planar sheet of conductive material;

forming first and second opposing, spaced apart, parallel conductive surfaces of substantially equally dimensions form said sheet by folding said sheet, an edge of said first surface being electrically connected to a corresponding edge of said second sheet by a shorting section of said sheet, said forming step including dimensioning said first and second surfaces so as to provide a quarter-wavelength cavity;

drilling a hole through said shorting section;

passing an end of a coaxial transmission line having a center conductor and a ground conductor through said hole;

electrically connecting said transmission line end between said first and second surfaces; and mechanically mounting said folded sheet to an interior surface of an outer exterior non-conductive shell of a motor vehicle.

19. A method as in claim 18, wherein said connecting step includes the steps of:

determining a point on said first surface internal to the volume between said first and second surfaces which has an impedance equal to the impedance of said coaxial transmission line;

directly connecting said coaxial transmission line center conductor to said first surface at said point; and directly connecting said coaxial transmission line ground conductor to said second surface.

20. A method as in claim 18, further including the step of selecting the dimensions of said sheet to yield a substantially isotropic signal radiation pattern in at least two dimensions.

* * * * *